United States Patent [19]

Hoffbeck

[11] Patent Number: 4,569,151

[45] Date of Patent: Feb. 11, 1986

[54] CHRISTMAS TREE STAND

[76] Inventor: Larry W. Hoffbeck, R.R. 2, Morgan, Minn. 56266

[21] Appl. No.: 562,235

[22] Filed: Dec. 16, 1983

[51] Int. Cl.[4] ..... A47G 7/02

[52] U.S. Cl. ..... 47/40.5; 47/39; 248/519

[58] Field of Search ..... 47/40, 47, 45, 39, 42, 47/43, 40.5, 44; 248/523, 524, 519, 539

[56] References Cited

U.S. PATENT DOCUMENTS

| | | | |
|---|---|---|---|
| 2,500,215 | 3/1950 | Swearingen | 47/40.5 |
| 2,522,156 | 9/1950 | Balmer | 47/40.5 |
| 2,755,050 | 7/1956 | Ford | 248/524 |
| 2,849,202 | 8/1958 | McCombs | 248/524 |
| 3,028,132 | 4/1962 | Austenson | 47/40.5 |
| 3,119,585 | 1/1964 | Austenson | 47/40.5 |
| 3,861,629 | 1/1975 | Merrill | 248/38 |
| 4,381,621 | 5/1983 | Eby | 47/40.5 |

*Primary Examiner*—Robert A. Hafer
*Assistant Examiner*—Bradley M. Lewis
*Attorney, Agent, or Firm*—Kinney & Lange

[57] ABSTRACT

A Christmas tree stand includes a unitary H-frame consisting of four stub feet forming a cross-shape base and extending radially horizontally outwardly from each other, a pair of parallel upright stanchions extending integrally upwardly from intermediate portions of two adjacent feet, and an H-bar or horizontal reinforcing brace integrally connecting intermediate portions of the upright stanchions to each other. Four hollow foot extension shoes are telescopically mounted on the stub feet to make the stand and a tree mounted in it stable against tipping. Flexible tree trunk retaining straps fasten around upper and lower portions of the stanchions and around the tree trunk to hold the tree in an upright position. A water bucket having vertical side walls is part of the stand and is positioned between the trunk of the tree and the stanchions at the butt of the trunk so that the weight of the tree is supported on the butt in the bucket and the bucket is supported on the foot/shoe assemblies which rest directly on the supporting surface.

11 Claims, 6 Drawing Figures

CHRISTMAS TREE STAND

BACKGROUND OF THE INVENTION

1. Field of the Invention.

This invention has relationship to Christmas tree stands and more particularly to a stand which can be adapted to accommodate a Christmas tree having branches extending outwardly from the trunk quite close to the butt of the tree, and to accommodate and hold substantially upright a Christmas tree which has a trunk which is not entirely straight.

2. Information Disclosure

It is known to support trees having non-uniform trunks at points along the trunks above the bottommost tree branches. Such a structure is shown in the patent to Eby, U.S. Pat. No. 4,381,621, patented May 3, 1983. This patent, however, requires a large permanent base member 18 which rests on the floor and fixedly supports a watering pan 44 situated in spaced relation to a block 20 into which a vertical member 22 has been inserted. A trunk engaging means 24 extends horizontally outwardly from the vertical member and includes a Y-shaped member 26 including arms 32 and 34 which form a crutch in which the trunk of the tree is placed. An elastic band 38 encircles the tree trunk and is attached back to the vertical member 22. A difficulty with the Eby stand may be that the support for the tree trunk is only at the base and at one point vertically along the base. Another difficulty is the bulk of the stand for storage purposes during the approximately eleven months of the year that it is not in use. The overall dimensions for storage purposes depend on the lateral dimensions of the base and the stability of the stand and tree when in use for two to five weeks once a year depends on the size of the base.

It is known to use extensible telescoping stabilizing legs on a tripod-like stand. This is shown in the patent to Merrill, U.S. Pat. No. 3,861,629, patented Jan. 21, 1975. This patent requires the use of guy wires to steady the tree, discloses a large and bulky watering pan 10, and shows the extensible feet and watering pan, as well as the guy wires extending substantially above the level of the floor surface, thus substantially destroying the effect of a tree growing in natural surroundings.

The patent to Austenson, U.S. Pat. No. 3,119,585, patented Jan. 28, 1964, discloses a pipe flange mounted in the bottom of a very wide watering pan, a pipe extending upwardly from the flange, and two clamp members bolted to the pipe, the clamp members being designed to clamp around the circumference of a Christmas tree at two separate points, holding the tree butt in any liquid placed in the watering pan. The stability of the Christmas tree support of Austenson is proportional to the diameter of the watering pan, and the watering pan will, therefore, take up considerable space during its eleven months of storage even if the pipe is unscrewed from the flange. Further, the clamps shown will fit only a rather limited range of tree trunk sizes.

The patent to Swearingen, U.S. Pat. No. 2,500,215, patented Mar. 14, 1950, shows a collapsible Christmas tree stand supported on legs extending at right angles to each other. The legs or bars are pivoted, along with a tree holding upright so that they can all lie parallel for storage. Casters are provided at the outer ends of the bars for shifting the tree stand when in use, and this necessarily elevates the bars off of the floor. A permanently installed water cup 6 is welded to one of the bars so that when all of the bars and the upright 11 are folded into parallel relationship with each other, the water cup extends outwardly at right angles with respect to the bar to which it is welded.

There are a large number of other tree stands, most of which are bulky and difficult to store and most of which embody some kind of an integrally attached water bucket or water cup or the like which must be stored with the stand. However, the foregoing represent the closest prior art found in a thorough preliminary patent search made on behalf of the applicant. Neither the applicant nor those in privity with him are aware of no prior art which is closer than that discussed above and are aware of no prior art which anticipates the claims herein.

SUMMARY OF THE INVENTION

A stand for supporting trees of all types including evergreens having branches extending out from the tree trunk relatively close to the butt of the trunk includes a cross-shape base comprising four stub feet each extending integrally, horizontally and radially outwardly of all of the others from a center; a pair of parallel upright stanchions each extending vertically upwardly from an intermediate portion of one of two of the stub feet, each of the stanchions being spaced the same distance as the other outwardly from the aforementioned center. These stanchions are spaced no farther apart than the diameter of the largest tree trunk which the stand is designed to support. Four separable elongate shoes are provided which can, in the form of the invention as shown, each be slipped over one of the stub feet telescopically to extend the effective length of that foot to broaden the base of support for the stand. In this disclosure, the feet are shown to be solid bar stock and the shoes hollow. Other configurations could be used to accomplish this same purpose. For example, the feet could be hollow and the shoes solid.

As shown, two flexible tree trunk retaining straps are provided, and means is provided near the top of the stanchions and slightly spaced from the bottom of the stanchions to support those retaining straps with respect to the stanchions while the retaining straps are put in encircling relationship with respect to the trunk of a tree to be supported.

In use, a vertically walled water bucket can be placed over the center or intersection point of the stand feet. The butt of the trunk of the tree to be supported can be set inside of the water bucket with the upwardly extending portion of the trunk in firm contact with both of the stanchions. The relationship of the stanchions to the tree trunk can be adjusted to accommodate irregularities in the trunk and the positioning of limbs extending outwardly therefrom until an optimum positioning is located which will allow the stand to position the tree in a most nearly upright position or in a position, regardless of the irregularities and direction of the trunk, which will cause the major portion of the tree to appear to be upright.

At that point, the two flexible tree trunk retaining straps, disclosed herein as being tension coil springs, will be connected to one or the other of the stanchions, wrapped firmly around the tree to hold it against the stanchions, and then hooked to the other stanchion or even back to the first stanchion if that should prove desirable.

Since the tree stand can include and support any of an extremely large number of sizes of vertical-walled water buckets, and inasmuch as plastic buckets, for example, are utilized to package enumerable products used in households at the present time, the water bucket need not be stored and sold as part of the stand initially, and can either be stored separately, or discarded after use, and replaced when a tree, for example a Christmas tree, is to be supported by the stand ten or eleven months after the stand is folded away. One gallon plastic buckets in which ice cream is sold have been found to be excellent for the purpose, because they will hold sufficient water to supply the needs of a evergreen in a heated environment for a considerable period of time, because they are readily available and easily replaced, and because they are plastic and not subject to corrosion and can therefore be used from year to year to year if so desired without being concerned with deterioration, corrosion and rusting which causes permanently mounted metallic water containers to leak. The failure of such water containers of the prior art often renders the entire stand unusable long before it has otherwise worn out due to the danger of supporting evergreens in heated rooms without any or adequate water being supplied to their base.

DETAILED DESCRIPTION OF THE PREFERRED EMBODIMENT

Figure 1:
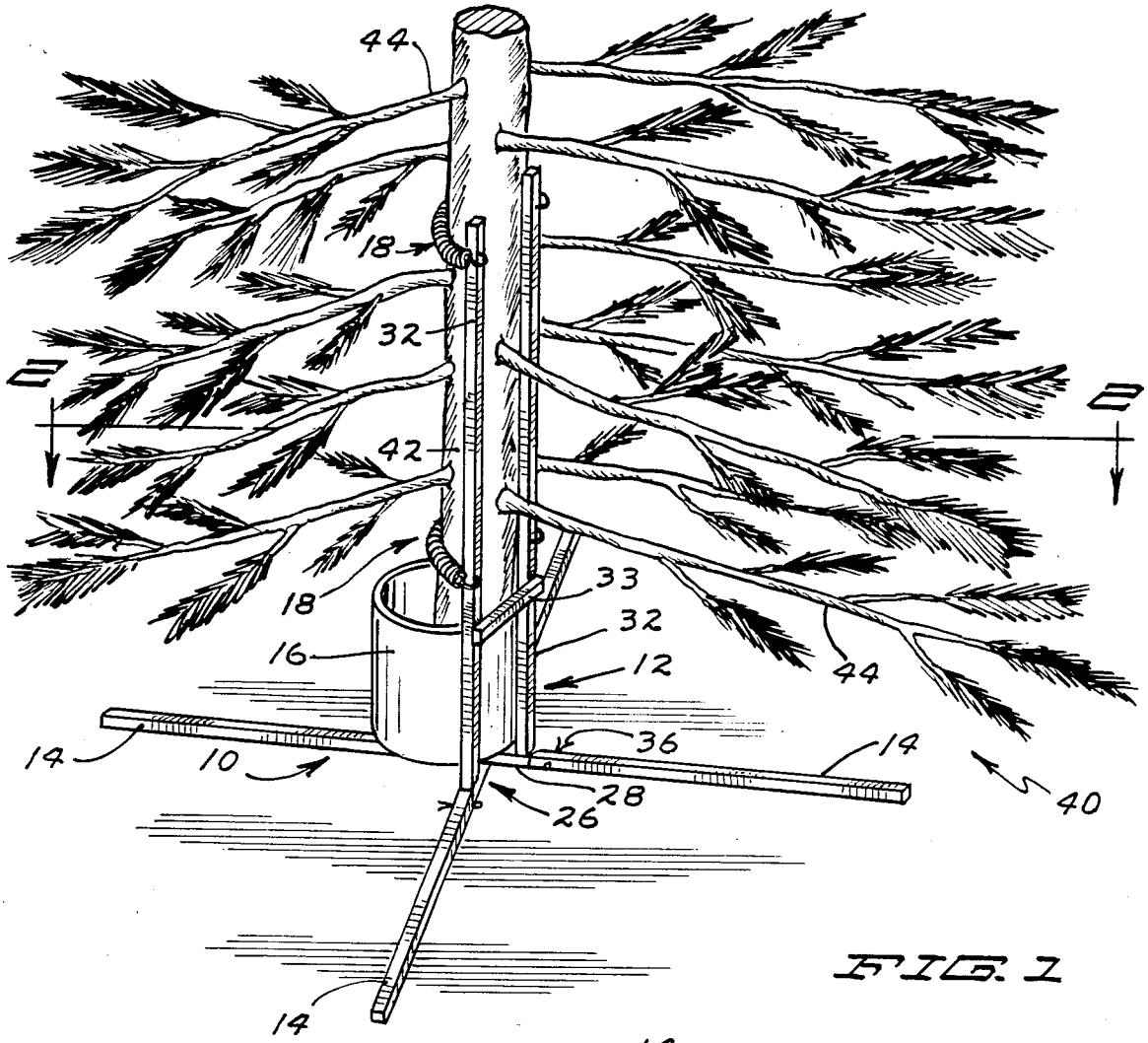
FIG. 1 is a perspective view of the tree stand of the invention showing its relationship to a tree to be supported.
Figure 2:
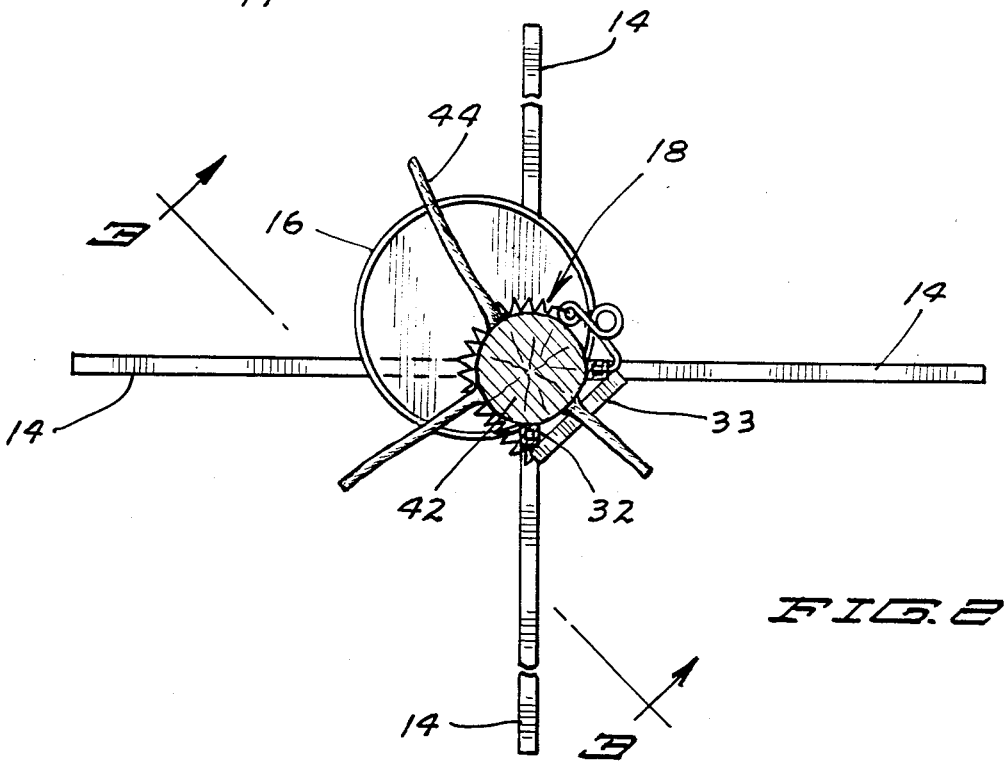
FIG. 2 is a top plan view of the stand and tree of FIG. 1 but taken generally on the line 2—2 in that figure.
Figure 3:
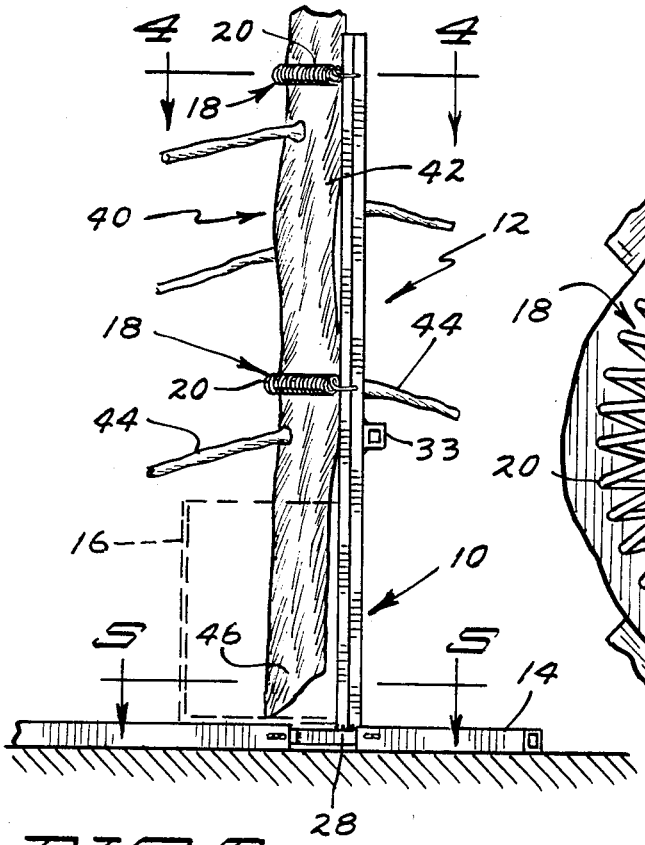
FIG. 3 is an elevational view of the stand and tree of FIGS. 1 and 2 taken generally on the line 3—3 in FIG. 2.
Figure 4:
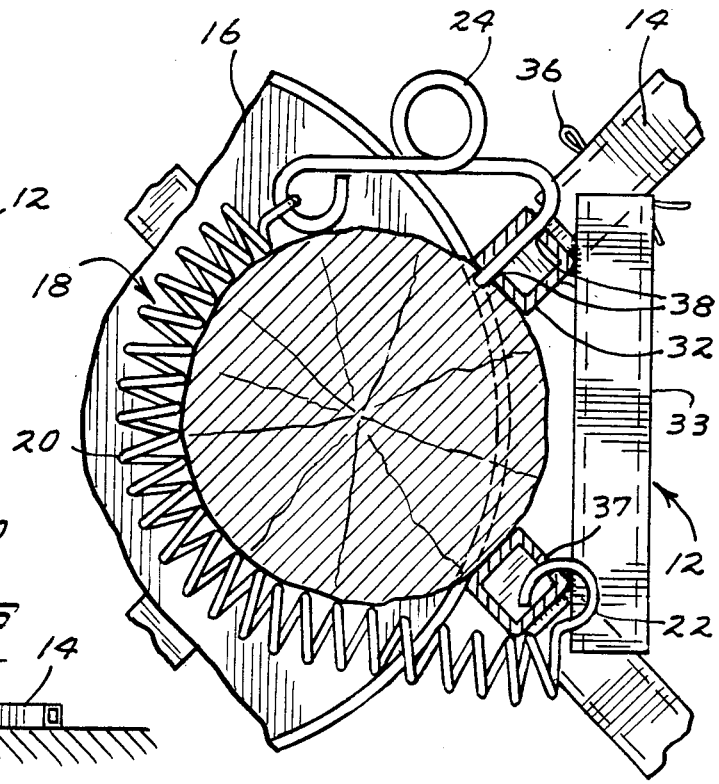
FIG. 4 is an enlarged fragmentary horizontal sectional view taken on the line 4—4 in FIG. 3.

A tree stand 10, for example a Christmas tree stand, includes a unitary H-frame 12, four separable and independent foot extension shoes 14, a water bucket 16, and two flexible tree trunk retaining straps 18, each herein disclosed as including a tension coil spring 20., a spring hook 22 at one end of the spring 20, and a spring tensioning and fastening hook 24 at the other end of the hook 20.

The unitary H-frame 12 includes a cross-shape base 26 made up of four stub feet 28 each foot extending integrally, horizontally and radially outward of the others from a base center area 30. As perhaps best seen in FIG. 5, each stub foot is positioned at 90° to its adjacent neighbors.

The H-frame 12 also includes a pair of parallel upright stanchions 32,32 each extending integrally upwardly from an intermediate portion of two of the adjacent feet 28,28, each stanchion being the same distance from the center 30 as the other. See FIGS. 1 and 5.

The unitary H-frame 12 includes a H-bar or horizontal reinforcing brace 33.

A tree to be supported, for example, a Christmas tree 40, includes a tree trunk 42 and branches 44 extending from the trunk. The termination or butt of the trunk is designated 46.

Figure 6:
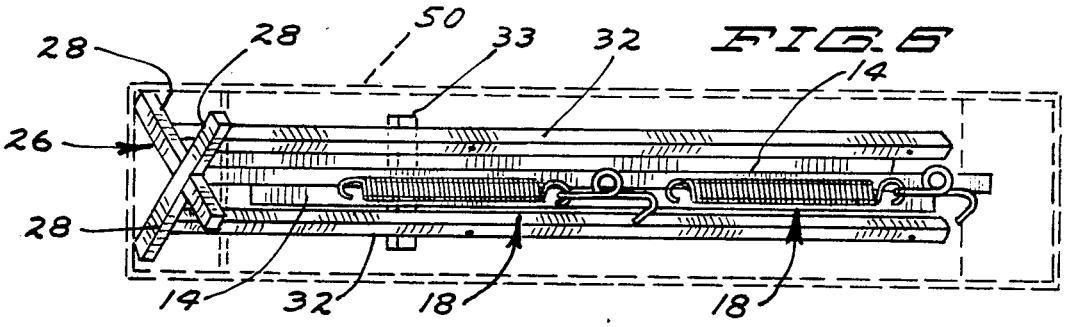
FIG. 6 is a perspective view of the parts of the stand of the invention, except the water bucket, positioned for storage and/or shipment with a carton therefor being shown in phantom.

To utilize the tree stand 10 of the invention, it is first removed from its storage and shipping carton 50, shown in phantom in FIG. 6.

Figure 5:
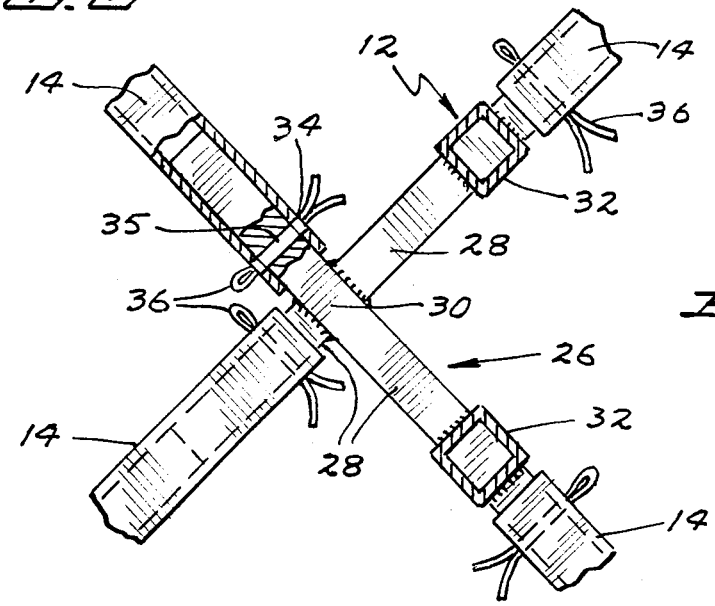
FIG. 5 is an enlarged fragmentary horizontal sectional view taken on the line 5—5 in FIG. 3.

In the form of the invention shown, the stub feet 28 are each constituted as solid metallic bar stock, and the independent foot extension shoes 14 are each shown as hollow rectangular rods designed to fit snugly and telescopically over the ends of the stub feet 28. As seen in FIG. 5, cotter pin receiving openings 34 in shoes 14 and cotter pin receiving openings 35 in stub feet 28 are provided to receive cotter pins 36.

The tree stand can be fully set up as shown in FIGS. 1 through 5, after its parts are removed from the carton 50; or the tree can be laid on its side, and different positionings of the stanchions 32,32 can be tried to accommodate the branches 44 without having to cut any of them off. Also, any irregularities in the shape or direction of the trunk 42 can be taken into account by taking the optimum points of contact for the stanchions 32,32 along the trunk to the end that the tree will ultimately have the most nearly upright final positioning possible.

In either case, it will be advantageous to position the water bucket 16 between the trunk 42 and the stanchions with the bottom of the water bucket adjacent upper surfaces of the stub feet 28 and with the butt 46 of the tree in adjacent relationship to the inside bottom surface of the water bucket.

When the optimum positioning of the stanchions 32,32 with respect to the trunk 42 has been arrived at, whether or not the shoes 14 are in position, flexible tree trunk retaining straps 18,18 will be used to strap the stanchions and the tree trunk into fixed relationship with each other. In order to accomplish this, a single opening 37 in a first of the stanchions 32 is provided to receive the spring hook 22, and openings 38 through both walls of the second stanchion 32 are provided to receive the outermost end of the spring tensioning and fastening hook 24.

If the tree stand is not upright at this point, and the shoes 14 have not been installed to extend the effective length of the stub feet 28, the shoes will be telescopically inserted over the feet to align cotter pin receiving openings 34 in the shoes with cotter pin receiving opening 35 in each of the feet, and cotter pins 36 will be installed. The tree and stand can then be set into an upright position as seen in FIG. 1.

Water bucket 16 will then be filled with water plus whatever chemicals are needed or desired to prolong the life of the evergreen tree.

The tipping or upsetting of Christmas trees is an all too frequent occurrence, as is the severe drying out of the tree toward the end of the period that it is kept erected. In public places, for example in churches, it is often advisable in high traffic areas to insure that the tree is particularly stable to avoid accident and to avert possible tragedy. While the extension shoes 14 can be approximately 16" long to be effective in a home situation, much longer shoes can be used in areas of higher traffic density to insure safety. An advantage of the structure of the present invention includes the fact that the shoes themselves rest directly on the floor or rug, and that they, being separate entities, can be easily painted or otherwise camouflaged to be unobtrusive. Furthermore, the support of the weight of the tree on its butt 46 on the bottom of the water bucket 16 which itself is resting directly on the stub feet 28 and extension shoes 14 provides the lowest possible center of gravity. For a normal five foot to twelve foot Christmas tree, stanchions which are 24" high combined with shoes which are 14" long have been found to be entirely satisfactory. A water bucket which holds up to one gallon of liquid, when used as part of the tree stand, even in relatively dry environments, will only have to be attended once or twice each week.

Although the present invention has been described with reference to preferred embodiments, workers skilled in the art will recognize that changes may be made in form and detail without departing from the spirit and scope of the invention.

What is claimed is:

1. A stand for supporting a Christmas tree or the like, said stand including:

a cross-shape base comprising four stub feet, each foot extending rigidly integrally, horizontally and radially outward of all of the others from a center;

a pair of parallel upright stanchions, each stanchion extending integrally upwardly from an intermediate portion of one of two of the stub feet, the stanchions being situated in equal spaced relation from the center, and the distance between the stanchions being no greater than the diameter of the largest tree trunk which the stand is designed to support;

four elongate shoes, each of configuration to be telescopically, longitudinally rigidly but removably assembled with one of said feet to extend the effective length of said foot in supporting relation to said stanchions;

at least two flexible tree trunk retaining straps; and strap support means to support opposite ends of each of said straps in temporarily fixed relation to one of said stanchions while supporting said straps in vertically spaced relation to each other and in encircling relation to the trunk of a tree to be supported.

2. The tree stand of claim 1 wherein:

shoe fastening means is provided to releasably fasten each foot and shoe against longitudinal movement with respect to each other when in mutually assembled relation to each other.

3. The tree stand of claim 2 wherein:

shoe fastening means is constituted as aligned pin-receiving openings extending through each such foot and shoe when assembled, and pin means to extend through said aligned openings.

4. The tree stand of claim 1 wherein:

at least one support strap is constituted as a spiral tension spring with hook means at each end thereof; and said strap support means includes said hook means and openings in said stanchions to receive said hook means.

5. The tree stand of claim 4 wherein:

said stanchions extend upwardly from one of two adjacent stub feet; and a single horizontal reinforcing brace integrally connects said stanchions to each other at sides thereof opposite said foot/base center.

6. The tree stand of claim 5 wherein:

said brace is positioned on said stanchions below the lowermost of said strap support means openings.

7. The tree stand of claim 4 wherein:

said stand includes a water bucket having at least one vertical side of height less than the vertical distance between the lowermost strap support means openings and the uppermost surface of the foot/shoe assemblies; and the water bucket is positioned against movement when a tree trunk is held in the stand by the tree trunk, the stanchions and said uppermost surfaces of the foot/shoe assemblies.

8. The tree stand of claim 1 wherein:

each elongate shoe is at least four times as long the length of the longest of the four stub feet.

9. The tree stand of claim 1 wherein:

none of the stub feet is longer than one-quarter of the length of the shortest elongate shoe.

10. The tree stand of claim 8 wherein:

each elongate shoe is over five times as long as the longest of the stub feet.

11. The tree stand of claim 9 wherein:

each of the stub feet is less than one-fifth the length of the shortest elongate shoe.

* * * * *